US009441469B2

(12) United States Patent
Morris et al.

(10) Patent No.: US 9,441,469 B2
(45) Date of Patent: Sep. 13, 2016

(54) SUBMERSIBLE PROGRESSIVE CAVITY PUMP DRIVER

(75) Inventors: Collin Rickey Morris, Lloydminster (CA); Joseph Henry Reck, Lloydminster (CA); Adam Budenski, Lloydminster (CA)

(73) Assignee: CJS PRODUCTION TECHNOLOGIES INC., Lloydminster, Alberta (CA)

( * ) Notice: Subject to any disclaimer, the term of this patent is extended or adjusted under 35 U.S.C. 154(b) by 777 days.

(21) Appl. No.: 13/882,419

(22) PCT Filed: Sep. 13, 2011

(86) PCT No.: PCT/CA2011/050554
§ 371 (c)(1),
(2), (4) Date: Sep. 4, 2013

(87) PCT Pub. No.: WO2012/055036
PCT Pub. Date: May 3, 2012

(65) Prior Publication Data

US 2013/0333893 A1 Dec. 19, 2013

Related U.S. Application Data

(60) Provisional application No. 61/407,750, filed on Oct. 28, 2010.

(51) Int. Cl.
*E21B 17/02* (2006.01)
*E21B 21/00* (2006.01)
*E21B 43/12* (2006.01)
(Continued)

(52) U.S. Cl.
CPC ..... *E21B 43/129* (2013.01); *E21B 17/02* (2013.01); *E21B 21/00* (2013.01); *E21B 43/128* (2013.01); *F04B 47/06* (2013.01); *F04C 2/1071* (2013.01); *F04C 13/008* (2013.01); *F04C 15/0061* (2013.01)

(58) Field of Classification Search
CPC ..... E21B 17/02; E21B 21/00; E21B 43/128; E21B 43/129; F04B 47/06; F04C 13/008; F04C 15/0061; F04C 2/1071
See application file for complete search history.

(56) References Cited

U.S. PATENT DOCUMENTS 2,455,022 A * 11/1948 Schmidt ..... F04B 1/14 417/271
5,139,400 A 8/1992 Ide
(Continued)

FOREIGN PATENT DOCUMENTS

CA 2719121 11/2009

*Primary Examiner* — Daniel P Stephenson
(74) *Attorney, Agent, or Firm* — Ryan W. Dupuis; Kyle R. Satterthwaite; Ade & Company, Inc.

(57) ABSTRACT

In a rotary pump having a rotor and a stator in communication with hydrocarbon production tubing, a submersible pump driver assembly includes a drive motor having an output connected by a drive link to the rotor of the pump. A production housing of the drive assembly includes a production passage receiving the drive link in which the output axis of the drive motor is radially offset from the passage. A control line for providing a drive input to the motor is thus suited to extend alongside the production tubing. The driver assembly thus allows for flushing with only a coiled tubing unit as the coiled tubing can be readily inserted past the offset motor and the motor can be optionally run in reverse to improve flushing.

20 Claims, 3 Drawing Sheets

(51) Int. Cl.

| | |
|---|---|
| ***F04B 47/06*** | (2006.01) |
| ***F04C 2/107*** | (2006.01) |
| ***F04C 13/00*** | (2006.01) |
| ***F04C 15/00*** | (2006.01) |

(56) References Cited

U.S. PATENT DOCUMENTS

| | | | | |
|---|---|---|---|---|
| 5,611,397 | A | 3/1997 | Wood | |
| 6,868,912 | B2 | 3/2005 | Proctor | |
| 7,975,765 | B2 * | 7/2011 | Manson | E21B 37/00 166/105 |
| 8,225,873 | B2 * | 7/2012 | Davis | E21B 43/129 166/369 |
| 2003/0044299 | A1 * | 3/2003 | Thomas | E21B 43/129 418/206.9 |
| 2012/0018168 | A1 * | 1/2012 | Denny | E21B 43/128 166/369 |
| 2012/0063933 | A1 * | 3/2012 | Rumbaugh | F04B 47/06 417/410.1 |
| 2012/0181042 | A1 * | 7/2012 | Ahmed | E21B 43/126 166/369 |
| 2013/0333893 | A1 * | 12/2013 | Morris | E21B 43/128 166/312 |
| 2015/0176574 | A1 * | 6/2015 | DeArman | F04B 47/06 417/53 |

* cited by examiner

SUBMERSIBLE PROGRESSIVE CAVITY PUMP DRIVER

This application claims the benefit under 35 U.S.C. 119(e) of U.S. provisional application Ser. No. 61/407,750, filed Oct. 28, 2010.

FIELD OF THE INVENTION

The present invention relates to a hydraulic submersible driver for a rotary pump, for example a progressive cavity pump, in which the driver is offset in relation to the production tubing; and more particularly, the present invention relates to a method of operating the rotary pump using the driver so that the pump can be operated in reverse for flushing operations. The present invention further relates to a suitable connector for connection between the driver and the production tubing so that control lines of the driver can be located alongside and externally of the production tubing.

BACKGROUND

Currently, and in the past, progressive cavity pumps have been ran in two pieces. First, the stator portion is ran in on standard jointed tubing. Then, the rotor portion is ran in on either jointed rods, or co-rod and stabbed into the stator. The rods are then connected to a rotary head at surface which turns the entire rod string and subsequently the rotor, which is inside the stator, and thus creating the pumping action. This type of system has a large number of disadvantages. The entire process requires multiple pieces of equipment, service rig, rod rig, co-rod rig, accelerators, tubing x-ray inspectors, etc. which leads to high service times and large man power exposure. Due to the nature of the pumping system it also requires various down hole and surface tools, such as stuffing boxes, no turn tools, tubing rotators, rotary heads, tag bars, etc.

One of the main disadvantages of this system is the mechanical wear that occurs on the rod and tubing string due to the rotation of the rods. This usually eventually wears holes in the jointed tubing, and weakens the rods. This leads to rod/tubing failures, which then require servicing. Additionally, because the rods are rotated from surface, when a pump seizes or fails, the rotary head at surface builds up and stores torque. This creates the necessity to run additional tools such as an anti-rotational tool. This is ran, because when the torque is let off of the rod string the string tends to back turn violently (which besides being a safety concern) can cause the tubing to back off and come apart, thus falling down hole. This highlights another limitation of this system in that you cannot turn the rotor backwards (which would be advantageous) because the tubing may back off, or any of the rod connections may back off because when rotating backwards, the threads can loosen off.

The rod/tubing combination is also a limitation because the rods are ran inside the production tubing which then takes up space and causes additional restriction of the production area. The rods also increase the overall surface area, which increases friction loss. Additionally the friction loss is difficult to combat because of the concentric nature of this design. Alternative materials (plastics, fiberglass, etc.) that would normally assist in friction reduction cannot be used due to the aggressive nature of the rotation of the steel rods.

It is also difficult to space out the rotor properly. Spacing out, is when the rotor and rods are ran into the well and the rotor is stabbed into the stator, it is necessary to land it in an appropriate place so that as the rod string stretches due to string weight and other factors, the lobes line up with the cavities. To do this a tag bar is normally ran on the bottom of the stator. This allows the rig crew to lower the rotor until it tags the tag bar. Then measurements are used to pull up to a certain spot and hang the rod string. This action, while fairly reliable, is by no means certain.

The current method of application of rods and tubing is all steel. This is a major drawback, as these types of wells tend to have a variety of corrosive fluids and gases present. This very often leads to corrosion issues on the production string and rods, as well as scale build up in the production string and rods. It would be very advantageous to use plastic lined products as the production conduit for corrosion/scaling protection, as well as friction reduction. Due to the rotary action of the rods, lined jointed tubing cannot be used as the rods would beat it up, and destroy it with their rotary motion and wear.

The conventional system of rod strings extending through the production string allows for a multiple unit service called a flush. Often with heavy oil wells, the pump sands off and this requires servicing. To do this, often instead of pulling the entire completion, a coiled tubing unit with small coil is brought to location, where it then runs in beside the rods and tubing, down to the top of the rotor where the tubing string is then circulated clean. The coil unit then pulls out of the well, and a flush-by unit is used to pull the entire rod string up which is connected at the bottom to the rotor. This action pulls the rotor out of the stator. The flush-by then begins to inject water or oil into the production string forcing the through the stator into the well bore, forcing the well onto a vacuum. Once a certain amount of fluid has been pushed into the formation, the rotor is lowered back into place, the rod string is re-hung, and standard pumping operations begin. This operation also requires multiple service units, and often, because of the unpredictability of the rods inside of the production tubing, the coil unit may not be able to get entirely down, or worse, could become stuck, or lodged around the rods. Basically, things start to get pretty congested with rods and coiled tubing inside of small diameter, normally 3.5' O.D., production tubing.

When a flush is preformed, the fluid that is pushed/flushed down into the well bore mixes with any solids in the hole, and helps to suspend the solids for a time so that when you put the pump back on normal operations, the mix of fluids and solids can be pumped to surface as per normal. In order to perform the aforementioned flush, currently it is necessary to remove the rotor from the stator so that one can flush down through the stator into the well bore with a fluid pump at surface. Once this is achieved, the rotor is then lowered back into the stator, and normal pumping operations can resume.

This moving of the rotor up and down is usually accomplished with the above mentioned flush-by unit, or a service rig, both of which normally have the fluid pump with them. It is time consuming, and typically does not occur until the rotor has already torqued up due to solids as the only way to diagnose this prior to torquing up is with logic programming. Unfortunately if the programming reads it is torquing up, all it can do is shut it down. The system then sits static until equipment can be mobilized, (which can be days) and while the well sits idle, the solids that are suspended in the production column begin to settle back down on top of the rotor, which typically means that when the equipment arrives, the flush-by cannot pull the rotor out of the stator to perform the flush. The well then also requires a coiled tubing unit to clean out on top of the rotor before the flush can begin. If the coil unit is unsuccessful, a complete service may be required with a service rig which includes pulling everything out of the hole, including the tubing.

In current configurations, the progressive cavity pump (PCP) is deployed on standard tubing and rods (or co-rod). As mentioned above, the connections that are inherent with this type of system are prone to backing off if the rods/pump are turned backwards. Additionally, as the rods torque up, they store energy, so that once the system goes down on high torque, the rods have a lot of stored energy. To release that energy, the rotary heads at surface are turned backwards, or the hydraulic pressure is allowed to bleed of, which allows the torque in the rods to dissipate by back spinning, sometimes very violently. When this occurs, there is a risk of the aforementioned back off of the tubing.

If that occurs, the tubing/rods can fall down the hole, causing additional problems. Currently, to combat this backing off of the tubing, an external no-turn tool is commonly ran. It is connected towards the bottom of the tubing string, and contacts the casing of the well, and stops the tubing from turning backwards in the event of the rods spinning backward. It does not stop the rods from backing off as mentioned above, as the rods are inside the tubing, and the no-turn tool operates only on the jointed tubing. Because this tool is in contact with the casing, it is difficult, or impossible to get past it with anything to clean out the cellar/sump of the well. This means that over time, as the sump fills up with solids, the only way to clean it out, is to pull everything out of the hole, and perform a comprehensive cleanout. Flushes only flush to the intake of the pump, and do not clean the sump/cellar so periodic cleanouts are still necessary.

SUMMARY OF THE INVENTION

According to one aspect of the invention there is provided a submersible pump driver assembly for use with a rotary pump having a stator and a rotor rotatable therein and which is in communication with production tubing extending in a longitudinal direction in a well casing, the pump driver comprising:

a drive motor comprising a rotary output rotatable about an output axis extending generally in the longitudinal direction and an inlet port arranged to receive a drive input;

a production housing including:

- a production passage extending between a production outlet arranged for connection in series with the production tubing thereabove and a production inlet arranged for connection in series with the stator of the rotary pump therebelow; and
- a motor connection through which the rotary output of the drive motor is arranged to communicate;

at least one control line arranged to extend alongside the production tubing and to communicate the drive input from a wellhead of the well casing to the inlet port of the drive motor so as to drive rotation of the rotary output relative to the housing about the output axis;

the drive motor being supported relative to the motor connection of the production housing such that the output axis of the drive motor is arranged to be offset in a radial direction in relation to at least a portion of the production passage of the production housing; and a drive link arranged to extend through the production inlet of the housing for connection in series between the rotary output of the drive motor and the rotor of the rotary pump so as to transfer rotation of the rotary output of the drive motor to rotation of the rotor in the stator of the rotary pump.

The driver and external control lines of the present invention eliminate many limitations associated with the use of rod stings to drive a pump. The entire system is ran concurrently with one coiled tubing unit.

The driver system relieves issues associated with rod and tubing wear, as it does not have rods, therefore no rod wear. It also does not store torque like a conventional system, as there are no rods to twist up and store energy. The motor is solidly connected to the pump which allows the pump to be turned backwards, which is advantageous for self flushing, and assuring de-torque.

The driver also alleviates issues with the rods occupying space in the production tubing, as it has no rods. Accordingly we are able to run alternative materials for our production tubing, which combats corrosion and can vastly extend the operational life of the entire string, and allows use of friction reduced products, which allows reduction of the overall size of the production tube, thus reducing cost and allowing for a greater range of activities in the size limited well bores.

The driver also alleviates issues with spacing out the rotor as the rotor is ran in place inside the stator already at the appropriate setting before placement downhole. As there are no rods again, there is no fear of the rotor shifting it's placement due to stretch, or other forces. The driver does not require a tag bar tool.

The driver allows for the same type of flush servicing as the prior art, but in a much easier and more reliable fashion. First of all, only the coiled tubing unit (CTU) is required, not a flush-by as well. The CTU runs inside of the production tube very easily as there are no rods, past the motor which is off center to allow this and down to the top of the rotor. The production tube is then circulated over and cleaned out. In order to flush the well, the motor is run in reverse, turning the pump backwards which is possible because we have no rods or tubing to worry about turning off. Once the well is flushed, the system is put on normal pumping operations.

With the driver, it is also possible to run composite/plastic production conduits because there are no damaging rods. Normally, the composite/plastic products also could not be ran because of tensile strength limitations, but by also incorporating steel control lines as hydraulic circuits, the steel hydraulic conduits also support the entire weight including the composite product.

As described herein, the hydraulic submersible progressive cavity pump (HSPCP) driver is designed to combat many disadvantages of the prior art. It combines all of the service equipment (rigs, co-rod, flush-by etc.) into one unit, which is a coiled tubing unit, with which a Flatpak™ in general is designed to be deployed and serviced with. Flatpak™ relates to a production tubing as described in PCT publication WO2009/049420 by Collin Morris. As it is a continuous system that is deployed/retracted in one run, it does not have the need for other services. As it is all deployed at the same time, there is no need for a rod string, which removes many of the aforementioned inherit problems with the rods such as: no tag bar necessary, the rotor is ran in place resulting in factory spec fit at all times; torque up is not an issue, so no anti-rotation tools necessary; the pump can be rotated backwards, which is very advantageous; no-turn tools are unnecessary; rod radigan is unnecessary; stuffing boxes are unnecessary; horizontal deployment is no longer a rod wear problem as there are no rods; no rods; no jointed tubing; no service rig; no flush-by units; no co-rod; and no accelerator units.

The drive motor is preferably connected to the production housing such that the output axis of the drive motor is arranged to be offset in the radial direction in relation to the production outlet of the production passage of the production housing.

Preferably the drive motor is connected externally of the production passage of the housing such that the production passage is arranged to communicate alongside the drive motor.

In one preferred embodiment, the drive motor is connected to the motor connection of the production housing such that the output axis of the drive motor is substantially coaxial with the stator of the rotary pump.

The drive motor preferably comprises a hydraulic motor and said at least one control line is preferably arranged to convey the drive input in the form of hydraulic fluid between the wellhead and the drive motor.

The control lines preferably include a hydraulic supply line in communication with the inlet port of the drive motor and a hydraulic return line in communication with a return port of the drive motor. The control lines may also include a third injector line arranged for communicating fluids from the wellhead independently of the hydraulic supply line and the hydraulic return line.

Preferably there is provided a connector arranged for connection between the production housing and the production tubing and said at least one control line. Preferably the connector comprises an integral body having a production port arranged for communicating between the production tubing and the production passage of the production housing and an auxiliary port associated with said at least one control line and arranged for communicating between the control line and the drive motor.

When used with existing jointed production tubing, the production port preferably comprises a threaded connector for threaded connection to jointed production tubing.

The auxiliary ports are preferably arranged for connection to the respective control lines independently of the connection to the production tubing. In some instances the auxiliary ports comprise a protrusion formed on the integral body of the connector which is arranged for compression fit into the respective hydraulic control line. Alternatively, the auxiliary ports may be coupled to the integral body of the connector by a threaded connection, a welded connection, silver soldering, or a dimpled connection for example.

In some instance, the control lines and the production tubing each comprise continuous tubing members and all of the continuous tubing members are commonly encased in a seamless and integrally formed casing surrounding the continuous tubing members. The continuous tubing members are preferably connected to the respective tubing members by substantially identical connecting means. The connecting means may comprise a compression fit, a threaded connection, a welded connection, silver soldering, or a dimpled connection for example.

Preferably the rotary pump comprises a progressive cavity pump in which the rotor is eccentrically rotatable within the stator and the drive link comprises a rigid member connected between the rotary output of the drive motor and the rotor of the progressive cavity pump having a length arranged to transfer rotation of the rotary output of the drive motor to eccentric rotation of the rotor in the stator of the progressive cavity pump using fixed connections between the rigid member of the drive link and each of the rotary output and the rotor.

According to a second aspect of the present invention there is provided a method of operating a rotary pump having a stator and a rotor rotatable therein which is in communication with production tubing extending in a longitudinal direction in a well casing, the method comprising:

providing a pump driver assembly comprising:

a drive motor comprising a rotary output and an inlet port arranged to receive a drive input; and a production housing including a production passage extending between a production outlet and a production inlet, and a motor connection;

connecting the production housing of the pump driver assembly in series between the production tubing in communication with the production outlet and the stator of the rotary pump in communication with the production inlet;

connecting the drive motor of the pump driver assembly with the motor connection of the production housing such that the output axis of the drive motor is arranged to be offset in a radial direction in relation to at least a portion of the production passage of the production housing;

connecting a drive link through the production passage between the motor connection and the production inlet of the production housing so as to be connected in series between the rotary output of the drive motor and the rotor of the rotary pump so as to transfer rotation of the rotary output of the drive motor to a rotation of the rotor in the stator of the rotary pump;

providing at least one control line extending externally alongside the production tubing; and driving rotation of the rotary output relative to the housing about an output axis extending in the longitudinal direction by communicating the drive input from a wellhead of the well casing to the inlet port of the drive motor through said at least one control line.

The method may include flushing the well casing by injecting coiled tubing through the production tubing, injecting fluid into the production tubing adjacent the rotary pump through the coiled tubing, and driving rotation of the rotor of the rotary pump in a reverse direction to pump the injected fluid downwardly through the stator of the rotary pump into the well casing.

When the drive motor comprises a hydraulic motor and said at least one control line comprises a hydraulic supply line in communication with the inlet port of the drive motor and a hydraulic return line in communication with a return port of the drive motor, the method preferably includes driving rotation of the rotor of the rotary pump in the reverse direction by reversing a flow of hydraulic fluid in the hydraulic supply and return lines.

When monitoring a torque value of the rotary pump, the method may further include providing a controller arranged to automatically operate the rotary pump for a prescribed duration in a reverse direction to pump fluid downwardly through the stator in response to the torque value exceeding a prescribed torque limit.

The method may also include injecting fluid into a sump area below the rotary pump by injecting coiled tubing into the well casing alongside the production tubing and operating the rotary pump while the fluid is injected into the sump area.

Preferably the rotor is positioned in the stator of the rotary pump prior to injecting the production tubing down into the well casing so that the control lines are injected alongside the production tubing as the production tubing is injected into the well.

According to another aspect of the present invention there is provided a tubing connector for use with a production assembly in a well casing including production tubing extending in a longitudinal direction in the well casing; a rotary pump having a stator and a rotor rotatable therein; a production housing including a production passage extending between a production outlet arranged for connection in series with the production tubing thereabove and a production inlet arranged for connection in series with the stator of the rotary pump therebelow; and a hydraulic pump drive motor connected to a motor connection of the production housing and which has a rotary output connected through the production inlet of the production housing to the rotor of the rotary pump; the tubing connector comprising:

an integral body arranged for connection in series between the production housing and the production tubing;

a production port in the integral body arranged for communicating between the production tubing and the production passage in the housing;

the production port comprising a threaded connector for threaded connection to the production tubing; and at least one auxiliary port in the integral body which is separate and external from the production port and which is arranged for connection between the hydraulic pump drive motor and a respective pump drive control line extending externally alongside the production tubing.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
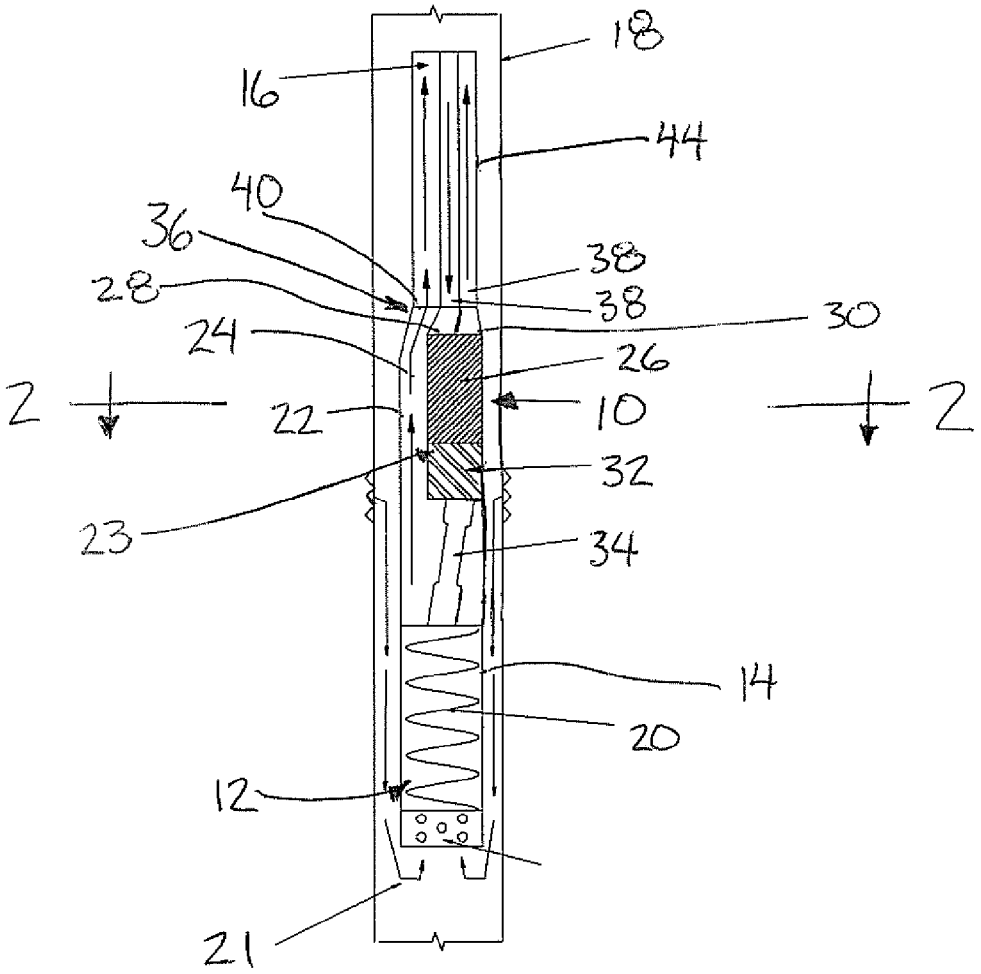
FIG. 1 is a schematic elevational view of the hydraulic submersible driver assembly for a progressive cavity pump in a production assembly in a well casing.

Referring to the accompanying figures, there is illustrated a hydraulic submersible progressive cavity pump driver assembly generally indicated by reference numeral 10. The driver assembly 10 is intended for use with a rotary pump such as a progressive cavity pump 12 used on a production tubing string in a production assembly of a hydro-carbon producing well.

Although various embodiments of the driver assembly 10 are described herein, the common elements of the various embodiments will be described first.

The progressive cavity pump 12 includes a stator 14 comprising a tubular housing connected in series with production tubing 16 at the bottom end of the tubing string such that the housing extends in the longitudinal direction of the surrounding well casing 18. The pump further comprises a rotor 20 supported within the stator 14 for relative rotation such that lobes on the rotor interact with lobes on the stator to produce the progressive cavity pumping action. Due to the interaction of the lobes, the rotor is rotated eccentrically in relation to the stator. A forward rotation of the rotor corresponds to upward pumping of fluid from the surrounding well casing through the pump intake 21 at the bottom of the stator and subsequently upwardly through the production tubing 16 to the well head at the surface.

The driver assembly 10 includes a production housing 22 which is connected in series between the stator 14 of the progressive cavity pump therebelow and the production tubing 16 extending thereabove. The housing includes a production passage 24 communicating through the housing between a production outlet at the top end of the housing which is arranged for connection in series with the production tubing thereabove and a production inlet at the bottom end of the housing which is arranged for connection in series with the stator of the pump therebelow. The bottom opening of the production inlet fully spans and aligns with the top opening of the stator of the progressive cavity pump. Similarly, the top opening of the production outlet is sized to fit and align with the production tubing with which it communicates. In the illustrated embodiments the top opening of the production outlet is offset laterally to one side in relation to the bottom opening of the production inlet therebelow.

The production housing 22 also includes a motor connection 23 arranged for connection to a drive motor 26 of the driver assembly 10. The motor connection 23 is a branched passage connected to the production passage so as to be located in parallel with the production outlet adjacent the top end of the production housing. In this instance, the output of the drive motor connected to the motor connection 23 and the production tubing connected to the production outlet of the production passage can both communicate commonly through the production inlet at the bottom end of the production housing while the drive motor 26 and the production fluids directed to the production tubing remain separated and laterally offset from one another.

The drive motor 26 comprises a hydraulic motor in the illustrated embodiment. The motor includes an inlet port 28 for receiving a drive input in the form of hydraulic fluid from a suitable supply of fluid. Also located at the top end adjacent the inlet port is a return port 30 for returning the hydraulic fluid back to the supply. The hydraulic motor includes an impeller therein which is driven to rotate by the flow of hydraulic fluid which in turn drives a rotary output of the motor at the bottom end thereof. The rotary output is driven to rotate about a respective vertical output axis oriented parallel to the longitudinal direction of the production tubing and well casing.

The drive motor 26 is supported relative to the production housing 22 such that the output axis of the motor is offset in a radial direction from a central longitudinal axis of the production outlet of the production housing to which the production tubing is connected in series. More particularly, the output axis is offset from an upper portion of the production passage 24 extending through the production housing along one side of the motor.

The drive motor 26 is mounted within a respective motor chamber connected to the production housing which is external and offset in relation to the production passage so that the motor chamber and the production passage are separated from one another. The bottom end of the motor chamber is sealed by a suitable bearing box 32 and stuffing box seals so that the rotary output of the drive motor can be connected to the rotor of the progressive cavity pump therebelow while isolating the drive motor in the motor chamber from the production fluids exiting the progressive cavity pump therebelow and passing through the production housing.

The output of the gearbox 32 is coupled by a suitable drive link 34 to the top end of the rotor of the pump. The drive link in the illustrated embodiment is a rigid member connected through the production inlet of the lower portion of the production passage of the production housing 22 so as to be connected in series between the output of the drive motor at the motor connection 23 of the production housing 22 and the rotor of the pump therebelow. The connection of the drive link to each of the rotary output of the motor and the rotor of the pump is a rigid connection without any pivotal or universal type connection being required due to the length of the drive link which may be in the order of 15 feet for example. The drive link thus has a sufficient length to transfer the rotation of the rotary output at the output axis to the eccentric rotation of the pump rotor therebelow while accommodating the slight angular offset between the drive motor output and the progressive cavity pump rotor to eliminate the eccentric motion without pivoting joints.

Below the drive motor, the production passage extending through the housing of the driver is open to the area of the motor connection 22 of the production housing below the gearbox which surrounding the drive link. The drive link thus extends through a lower portion of the production passage while an upper portion of the production passage passes alongside the motor connection 22 to the drive motor, while being offset in a radial direction in relation thereto.

The top end of the driver housing 22 makes use of a suitable connector 36 which is arranged for connection to the production tubing 16 as well as being arranged for connecting the inlet and return ports of the motor to respective control lines 38. Although various embodiments of the connector 36 and control lines 38 can be used, the common features of the various embodiments will first be described herein.

The connector 36 comprises an integral body having a production port 40 extending therethrough which communicates between the production tubing thereabove and the production passage of the housing 22 therebelow. The connector also comprises an auxiliary port 42 associated with each control line 38 which is separate, external and laterally offset from the production port 40 for independent communication between a respective port of the drive motor 26 and a respective control line 38.

The control lines 38 are external, separate and offset in a radial direction from the production tubing so as to extend alongside the production tubing through the well casing between the driver 10 and the well head thereabove. The control line serves to communicate the drive input from the wellhead to the drive motor. In the illustrated embodiment, the drive input comprises hydraulic fluid under pressure which is pumped downwardly from the wellhead through a respective control line to the inlet port of the drive motor and which is then subsequently returned through the return port and through a respective separate control line 38 back to the wellhead.

In alternative embodiments a single control line conducting electrical conduits therethrough for driving an electric drive motor can be used.

Figure 3:
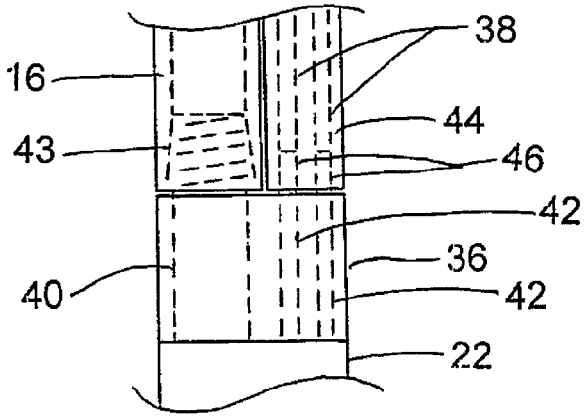
FIG. 3 is a front elevational view of a first embodiment of a connector between the pump driver and pump control lines which extend externally alongside the production tubing.

Turning now more particularly to the embodiment of FIG. 3, a connector 36 is shown for use with conventional jointed production tubing 16 in which sections of tubing are joined with threaded connections. In this instance the production port comprises a threaded projection formed integrally on the integral body of the connector onto which a lowermost section of the jointed production tubing is threadably connected.

The two control lines 38 shown in this instance comprise hydraulic conduits for respectively supplying and returning hydraulic fluids to the supply port and return port of the drive motor. The two control lines comprise suitable conduits for containing high pressure hydraulic fluid such as steel conduits which are encased in a common casing 44 which surrounds both control lines and forms a continuous member which is spoolable on a coiled tubing unit at the wellhead.

The two auxiliary ports 42 in the integral body on the connector in the illustrated embodiment comprise projections 46 which can be compression fit into the respective conduits of the two control lines so as to be frictionally retained therein by a suitable clamping or dimpling of the conduits about the compression fit projections 46 for interlocking connection therebetween in a mounted position. The connection of the auxiliary ports is thus independent of the connection to the production tubing. In further embodiments, the connection of the auxiliary ports may be accomplished by a compression fit, a threaded connection, a welded connection, silver soldering, a dimpled connection, or combinations thereof.

The two control lines in the common casing 44 can then be strapped to the production tubing to extend alongside the production tubing along the full length of the production assembly in the well casing; however strapping may not be necessary in some instance.

Figure 4:
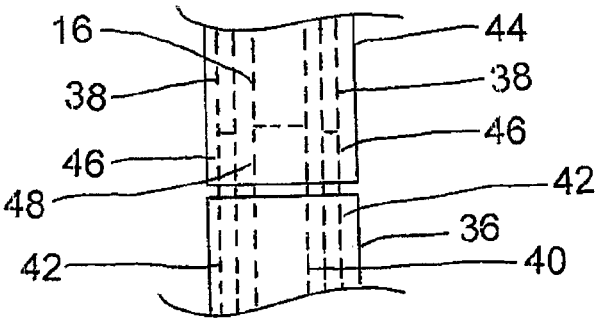
FIG. 4 is a front elevational view of a second embodiment of the connector between the pump driver and the pump control lines in which the pump control lines are encased in a common casing with the production tubing.

Turning now to the embodiment of FIG. 4, the two control lines 42 in this instance similarly comprise hydraulic supply and return conduits preferably formed of steel which are connected to compression fit projections 46 on the integral body in the manner described above. The embodiment of FIG. 4 differs from the previous embodiment in that the production tubing in this instance comprises a continuous spoolable tubing member of composite material which is encased in the common casing 44 together with the two control lines which are also continuous, spoolable tubing members. The production tubing and two control lines together with the surrounding elastomeric casing are described in further detail in PCT publication WO2009/049420 which is incorporated herein by reference.

The production port in this instance may also comprise a compression fit projection 48 similar to the projections 46 so as to be inserted into the respective conduit forming the production tubing with the conduit being clamped or deformed for interlocking gripping connection therebetween in the mounted position. In further embodiments, the connection of the production port may also be accomplished by a compression fit, a threaded connection, a welded connection, silver soldering, a dimpled connection, or combinations thereof. Typically, the production port and the auxiliary ports are connected by identical connections to the respective continuous tubing members of the common casing 44.

The integral body of the connector in this instance serves to redirect the production tubing centrally mounted between the two control lines to the respective production passage extending through the production housing of the driver assembly while the two control lines are redirected for communication with the offset drive motor connected to the offset motor connection of the production housing of the driver 10.

Figure 2:
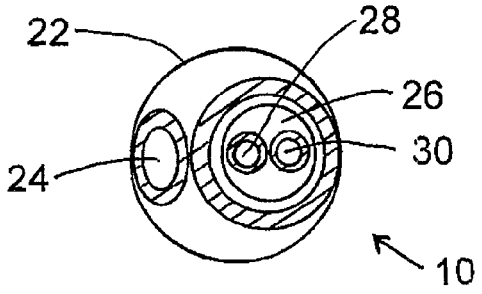
FIG. 2 is a sectional view along the line 2-2 of FIG. 1.

Turning now more particularly to the first embodiment of the production housing 22 of FIGS. 1 and 2, the motor connection 23 in this instance comprises an integral connection between the production housing and the motor chamber locating the drive motor 26, and bearing box 32 therein. The production passage of the production housing is supported to extend alongside the drive motor such that the production outlet at the top end of the housing and the input to the drive motor are arranged for direct connection to the connector 36 which connects to the production tubing and the control lines thereabove. The drive motor is supported in this instance by the motor connection of the production housing such that the output axis of the motor is offset in a radial direction from the stator of the progressive cavity pump therebelow and the production tubing connected to the production outlet of the production housing thereabove.

Figure 5:
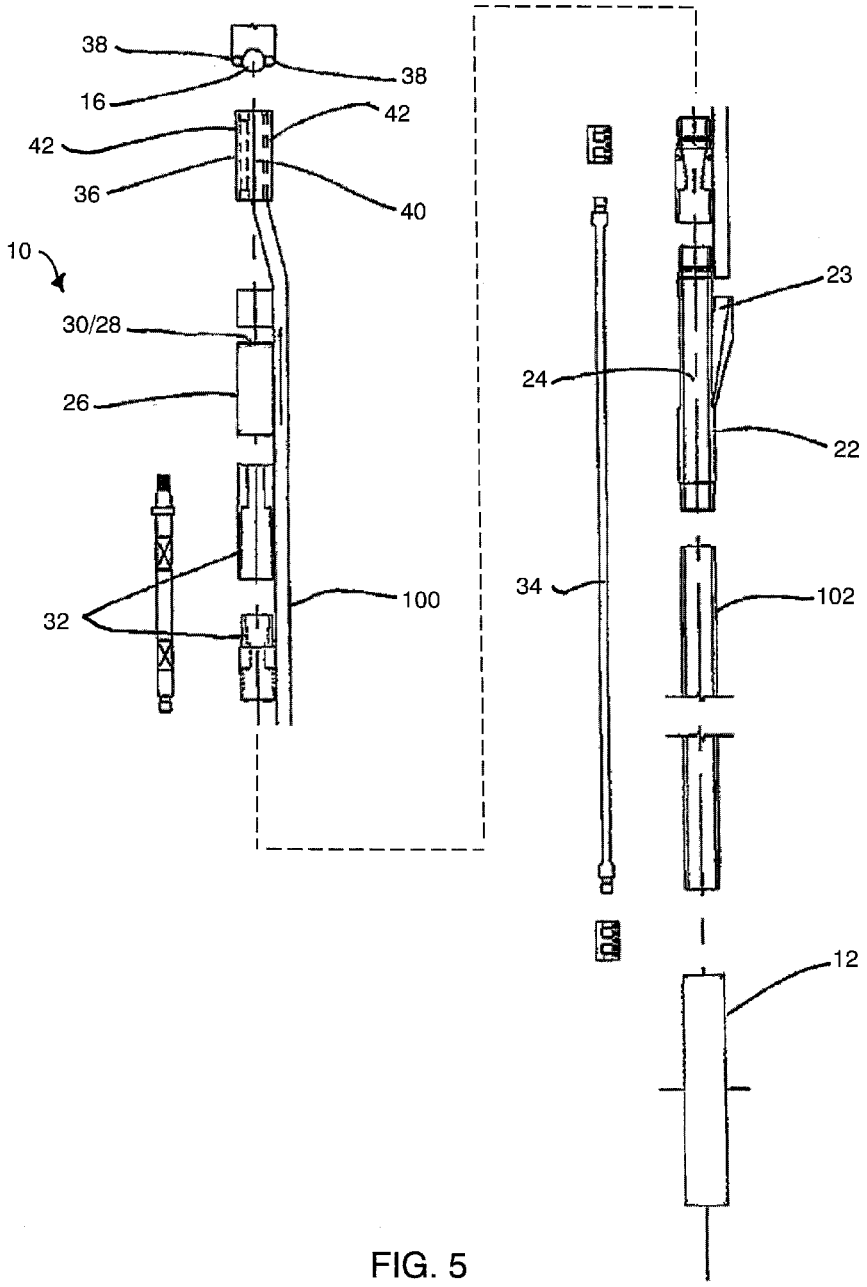
FIG. 5 is an exploded elevational view of a further embodiment of the hydraulic submersible driver assembly for a progressive cavity pump in a production assembly.

Turning now more particularly to the second embodiment of the production housing 22, as shown in FIG. 5, the drive motor in this instance is supported externally and separately above the production housing 22. The production housing in the second embodiment is substantially Y-shaped such that the branched passage of the motor connection 23 is substantially coaxial with the production inlet at the bottom end of the production housing while the production outlet at the top end of the production housing is inclined and offset laterally to one side of the motor connection and production inlet. The stuffing box of seals and the bearing box 32 connect the drive motor 26 to the motor connection 23 such that the output axis of the rotary output of the drive motor is coaxial with the production inlet and pump stator connected therebelow.

The top end of the drive link is thus connected to the rotary output so that the top end of the drive link is also coaxial with the pump stator therebelow. An additional drive housing 102 is connected coaxially and in series between the production inlet at the bottom of the production housing and the pump stator to accommodate the length of the drive link which may be in the order of 15 feet in length in the longitudinal direction as described above. Fixed couplings at the top and bottom ends of the drive link ensure fixed connection to the output of the motor and the top of the pump rotor respectively with the length of the drive link being sufficient to transfer the concentric rotation of the motor to eccentric rotation of the pump rotor without pivots being required also as described above.

In the second embodiment, the production outlet of the production housing 22 communicates in series with an auxiliary production tube 100 which extends alongside the drive motor between the production housing and the connector 36. A top end of the auxiliary production tube 100 may be offset from the bottom end such that the top end can optionally be located coaxially with the motor output at a location above the motor when the bottom end is coaxial with the production outlet of the production housing 22.

As shown in FIG. 5, when the second embodiment of the production housing 22 is used with the production tubing of FIG. 4, the production port in the connector may be arranged to connect between the production tubing thereabove and the auxiliary production tube 100 therebelow such that the motor is suspended in line below the production tubing with an output of the motor and the pump stator therebelow being substantially coaxial with a central longitudinal axis of the production tubing. To provide support between the drive motor 26 and the auxiliary production tube 100 a rigid support member may span the length of the auxiliary production tube so as to be rigidly fastened to both a housing of the drive motor 26 and the production tube 100 along the length thereof between the connector 36 and the production housing 22 to which the support member can also be fastened.

In use, the progressive cavity pump is first assembled by positioning the rotor in the stator before placement in the well casing. The drive motor is connected to the motor connection of the production housing and the bottom end of the production housing 22 is connected to the top end of the progressive cavity pump with the drive link connected between the output of the drive motor and rotor in the suitable manner. The bottom of the production tubing and the bottom ends of the control lines are then connected to the top of the production housing and motor using the connector 36. In both embodiments the control lines are supported externally and alongside the production tubing so that the production tubing and the control lines are injected into the well casing together as the production assembly is lowered into the well casing to its production position.

When using jointed production tubing, the control lines can be strapped alongside the production tubing as it is inserted into the well casing. Alternatively when the production tubing comprises continuous spoolable tubing, the production tubing and the control lines can be spooled together from a single coiled tubing unit and injector head.

Once mounted in the desired production configuration, drive input is provided by supplying hydraulic fluid from the wellhead through the control lines to drive rotation of the hydraulic drive motor which in turn rotates the output thereof for rotating the rotor relative to the stator. The housing of the drive motor is anchored relative to the housing of the driver 10 which is in turn fixed relative to the stator of the pump and to the production tubing.

When it is desired to perform a flush, a second coiled tubing unit is provided and injected through the production tubing as well as through the production passage in the housing of the driver 10 until the bottom end of the injected tubing is located adjacent the top end of the progressive cavity pump. By switching the communication of supply and return control lines at the wellhead, hydraulic fluid can be directed through the control lines in the reverse direction for operating the drive motor in the reverse direction which in turn rotates the rotor relative to the stator in the reverse direction. The reverse direction of the progressive cavity pump corresponds to the injected fluids being pumped downwardly through the pump and into the surrounding well casing. Fluid may be continuously injected through the injected tubing from the second coiled tubing unit while pumping in the reverse direction for flushing the well with the rotor remaining intact within the stator of the progressive cavity pump.

In some instances, it may be desirable to configure the production assembly to perform an automatic flushing in response to determination that the progressive cavity pump is operating under excessive torque. This is accomplished by providing a controller which continuously monitors a torque value of the progressive cavity pump corresponding to the resistance to the driving rotation for operating the pump. The controller is arranged to determine when the torque value of the pump exceeds a prescribed torque limit and in response to this determination halts the forward operation of the pump, reverses the flow of hydraulic fluid through the control lines and then operates the pump in reverse for a prescribed duration. Injected fluids may be simultaneously injected in an automated manner by the controller in response to determination of the torque value exceeding the prescribed torque limit. After the prescribed duration or after it has been determined that the pump has been sufficiently flushed, normal forward pumping operation of the pump resumes.

For flushing the sump area of the well casing below the progressive cavity pump, injected tubing from a second coiled tubing unit can also be injected into the well casing alongside the production tubing instead of through the projection tubing until the bottom end of the injected tubing is located in proximity to the sump area of the well casing directly below the pump. A continuous injection of fluid in this instance while the pump operates in the forward direction causes the injected fluid to collect deposits in the sump area which are then pumped upwardly through the progressive cavity pump and upwardly through the production tubing to the surface until the sump area has sufficiently been cleaned out.

As described herein, the driver is specifically designed to be ran into a well bore on a FlatPak™ or other multi-tubular conveyance system where the tubulars are not concentric, but are arranged on the same horizontal plane, and are deployed at the same time, and where at least one conduit is an injector, and one conduit is a producer, or one may be electrical in order to run the driver electrically, preferably two conduits to form a continuous hydraulic circuit, and one production conduit for evacuating production fluids from the well bore. The driver is connected to both the conveyance medium, and the progressive cavity pump with the rotor in place, and then deployed simultaneously. Hydraulics (or current) are then supplied to the driver, and the driver in turn runs the progressive cavity pump. Specifically, the driver turns the rotor, which is ran in place inside the stator so that production fluids then move to surface up the production conduit.

The "Driver" Motor is in place above the pump assembly, and is arranged slightly off center to allow for standard servicing when access to the top of the Rotor is necessary. Other systems, because of their concentric nature are "centered" within their respective tubular, and thus are difficult or impossible to service without a complete rig intervention, (pulling the entire system, fixing on surface, and redeploying, which with a concentric system adds significant time and equipment).

The HSPCP Driver is a subsurface rotary motor tool, which is driven by hydraulics, or electricity. It is designed to power all types of Rotary style pumps (centrifugal, Progressive Cavity, etc.) but specifically Progressive Cavity style pumps of all sizes.

The Driver allows for reverse action of the Progressive Cavity Pump. This allows the pump to pump backwards into the well bore, thus forcing fluid (and solids) back into the well bore and the formation. This is called a "flush". The driver allows for the system to "self flush" which is desirable, but with existing technology, it is difficult or impossible. The Driver makes it easy and reliable.

This is especially advantageous in Heavy oil wells where "flushing" the well (as this forward push of fluid is called) is desirable because sand can build up in the "sump" or "cellar" over time until it begins to restrict the in-flow of production fluids into the well bore from the formation, as well as restrict flow into the pump itself.

By powering the Progressive Cavity Pump hydraulically down hole with the driver, the service equipment for flushing normally associated with a rod string can be eliminated, and the pump can be made to "self flush" manually, or automatically, with programming logic. Because the driver is directly atop of the pump, and the system is deployed by FlatPak, there are no (or very few), threads that can be "backed off". In a normal completion with rods, tubing etc., each connection has a thread and therefore can back off if the torque is reversed, (which is why they don't do it). With the Driver, there are few or no connections, thus allowing the pump to be turned backwards without the fear of "backing off" a rod or Pipe connection. When the PCP is turned backwards, the fluid from the tubing is pump back into the well bore, thus performing the afore mentioned flush without any intervention equipment at all. Additionally, By automating the system, the hydraulic system can easily be made to automatically switch flow direction and perform a "self flush" whenever the pump begins to "torque" up. The system would read the increased hydraulic pressure at surface, indicating the rotor was beginning to get "tight", and before it got bad, the system would reverse hydraulic flow, thus turning the driver in reverse, which in turn would turn the PCP in reverse and "auto flush" the well. Once the torque had subsided, or a predetermined amount of fluid was flushed, the surface system would once again switch flow, and the driver/pump would resume normal pumping operations. By using this method, significant savings in servicing equipment, and down time can be realized.

In addition to self flushing, the HSPCP Driver allows for enough annular space, that a continuous fluid injection string can be installed beside the FlatPak.

With the PCP Driver and the FlatPak, issues associated with pulling up a rod string and backspinning rods are eliminated. As the "back off" issue no longer exists, the No-turn tool can be eliminated. This allows for periodic cleanouts into the cellar/sump PAST the down hole assembly. The Driver/pump can be left pumping, at the same time that coil tubing is ran into the well bore, past the driver, past the pump, and into the cellar/sump. Fluids can then be injected through that cleanout string to "stir up" the solids in the cellar/sump, and help lift them up to the pump intake. The pump can then pump the mixture to surface. This process eliminates down time, as the process can be done on the fly, and eliminates all of the additional service equipment associated with a complete work over.

In addition to cleanouts, permanent strings can be ran into the cellar and landed. These strings can then be used to inject a steady stream of fluids into the cellar/sump to ensure that solids don't build up.

Normally a HSPCP could be deployed using a FlatPak that incorporates both of the hydraulic conduits (hydraulic drive circuit) and the production tube. While this method is useful, there are many situations where jointed production tubulars are already available on site, and to save on cost it may be desirable to use the existing production tubular. When this is the case, it may be advantageous to use a smaller Flatpak that consists of only the hydraulic circuit (two tubular), or possibly two individual tubes (not in a FlatPak configuration) which powers the PCP Driver. In this case, a coiled tubing unit, spooling unit, (or some method of supplying the FlatPak/individual tubes) and a Service Rig, Drilling Rig, Flush-by (or some method of deploying the Jointed tubing) would be needed.

The PCP and Driver would be attached to the bottom of the production string (on the rig), and then the FlatPak (hydraulic conduit) or individual tubes would also be attached to the driver by way of a connector, which attaches beside the jointed production string to power the PCP Driver, (but outside the production string as to not inhibit internal flow). Then as the Jointed production string is lowered into the hole one at a time, the FlatPak/individual strings (hydraulic circuit) would be "slaved", or "piggy backed" into the well off of the Coiled tubing unit, or spooling unit. It may also be desirable to "band" or "strap" the FlatPak/individual strings to the side of the Production string at intervals for vertical support. Once on depth, the Jointed tubing would be landed, and the FlatPak terminated.

When retrieving this system, the process would simply be reversed. The jointed tubing would be pulled, and as it was retrieved one at a time, (bands/straps would be cut as they surface if they are present) and the FlatPak/individual strings would slowly be spooled up onto the coil/spooling unit. Once at surface, the Driver and PCP would be removed from the well bore.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A submersible pump driver assembly for use with a rotary pump having a stator and a rotor rotatable therein and which is in communication with production tubing extending in a longitudinal direction in a well casing, the pump driver comprising:

a drive motor comprising a rotary output rotatable about an output axis extending generally in the longitudinal direction and an inlet port arranged to receive a drive input;

a production housing including:

a production passage extending between a production outlet arranged for connection in series with the production tubing thereabove and a production inlet arranged for connection in series with the stator of the rotary pump therebelow; and a motor connection through which the rotary output of the drive motor is arranged to communicate;

at least one control line arranged to extend alongside the production tubing and to communicate the drive input from a wellhead of the well casing to the inlet port of the drive motor so as to drive rotation of the rotary output relative to the housing about the output axis;

the drive motor being supported relative to the motor connection of the production housing such that the output axis of the drive motor is arranged to be offset in a radial direction in relation to at least a portion of the production passage of the production housing; and a drive link arranged to extend through the production inlet of the housing for connection in series between the rotary output of the drive motor and the rotor of the rotary pump so as to transfer rotation of the rotary output of the drive motor to rotation of the rotor in the stator of the rotary pump.

2. The assembly according to claim 1 wherein the drive motor is connected to the production housing such that the output axis of the drive motor is arranged to be offset in the radial direction in relation to the production outlet of the production passage of the production housing.

3. The assembly according to claim 1 wherein the drive motor is connected externally of the production passage of the housing such that the production passage is arranged to communicate alongside the drive motor.

4. The assembly according to claim 1 wherein the drive motor is connected to the motor connection of the production housing such that the output axis of the drive motor is substantially coaxial with the stator of the rotary pump.

5. The assembly according to claim 1 wherein the drive motor comprises a hydraulic motor and said at least one control line is arranged to convey the drive input in the form of hydraulic fluid between the wellhead and the drive motor.

6. The assembly according to claim 5 wherein said at least one control line comprises a hydraulic supply line in communication with the inlet port of the drive motor and a hydraulic return line in communication with a return port of the drive motor.

7. The assembly according to claim 6 wherein said at least one control line further comprises a third injector line arranged for communicating fluids from the wellhead independently of the hydraulic supply line and the hydraulic return line.

8. The assembly according to claim 1 wherein there is provided a connector arranged for connection between the production housing and the production tubing and said at least one control line, the connector comprising an integral body having a production port arranged for communicating between the production tubing and the production passage in the housing and an auxiliary port associated with said at least one control line and arranged for communicating between the control line and the drive motor.

9. The assembly according to claim 8 wherein the production port comprises a threaded connector for threaded connection to jointed production tubing.

10. The assembly according to claim 9 wherein the drive motor comprises a hydraulic motor and said at least one control line comprises a hydraulic supply line in communication with the inlet port of the drive motor and a hydraulic return line in communication with a return port of the drive motor, and wherein the auxiliary ports are arranged for connection to the respective control lines independently of the connection to the production tubing.

11. The assembly according to claim 1 wherein said at least one control line and the production tubing each comprise continuous tubing members and wherein the continuous tubing members are commonly encased in a seamless and integrally formed casing surrounding the continuous tubing members.

12. The assembly according to claim 11 wherein there is provided a connector arranged for connection between the housing and the production tubing and said at least one control line, the connector comprising an integral body having a production port arranged for communicating between the production tubing and the production passage in the housing and an auxiliary port associated with said at least one control line and arranged for communicating between the control line and the drive motor.

13. The assembly according to claim 1 in combination with a rotary pump comprising a progressive cavity pump in which the rotor is eccentrically rotatable within the stator, the drive link comprising a rigid member connected between the rotary output of the drive motor and the rotor of the progressive cavity pump having a length arranged to transfer rotation of the rotary output of the drive motor to eccentric rotation of the rotor in the stator of the progressive cavity pump.

14. A method of operating a rotary pump having a stator and a rotor rotatable therein which is in communication with production tubing extending in a longitudinal direction in a well casing, the method comprising:

providing a pump driver assembly comprising:

a drive motor comprising a rotary output and an inlet port arranged to receive a drive input; and a production housing including a production passage extending between a production outlet and a production inlet, and a motor connection;

connecting the production housing of the pump driver assembly in series between the production tubing in communication with the production outlet and the stator of the rotary pump in communication with the production inlet;

connecting the drive motor of the pump driver assembly with the motor connection of the production housing such that the output axis of the drive motor is arranged to be offset in a radial direction in relation to at least a portion of the production passage of the production housing;

connecting a drive link through the production passage between the motor connection and the production inlet of the production housing so as to be connected in series between the rotary output of the drive motor and the rotor of the rotary pump so as to transfer rotation of the rotary output of the drive motor to a rotation of the rotor in the stator of the rotary pump;

providing at least one control line extending externally alongside the production tubing; and driving rotation of the rotary output relative to the housing about an output axis extending in the longitudinal direction by communicating the drive input from a wellhead of the well casing to the inlet port of the drive motor through said at least one control line.

15. The method according to claim 14 including flushing the well casing by injecting coiled tubing through the production tubing, injecting fluid into the production tubing adjacent the rotary pump through the coiled tubing, and driving rotation of the rotor of the rotary pump in a reverse direction to pump the injected fluid downwardly through the stator of the rotary pump into the well casing.

16. The method according to claim 15 wherein the drive motor comprises a hydraulic motor and said at least one control line comprises a hydraulic supply line in communication with the inlet port of the drive motor and a hydraulic return line in communication with a return port of the drive motor, the method including driving rotation of the rotor of the rotary pump in the reverse direction by reversing a flow of hydraulic fluid in the hydraulic supply and return lines.

17. The method according to claim 14 including monitoring a torque value of the rotary pump and providing a controller arranged to automatically operate the rotary pump for a prescribed duration in a reverse direction to pump fluid downwardly through the stator in response to the torque value exceeding a prescribed torque limit.

18. The method according to claim 14 including injecting fluid into a sump area below the rotary pump by injecting coiled tubing into the well casing alongside the production tubing and operating the rotary pump while the fluid is injected into the sump area.

19. The method according to claim 14 including positioning the rotor in the stator of the rotary pump prior to injecting the production tubing down into the well casing and injecting said at least one control line alongside the production tubing as the production tubing is injected into the well.

20. A tubing connector for use with a production assembly in a well casing including production tubing extending in a longitudinal direction in the well casing; a rotary pump having a stator and a rotor rotatable therein; a production housing including a production passage extending between a production outlet arranged for connection in series with the production tubing thereabove and a production inlet arranged for connection in series with the stator of the rotary pump therebelow; and a hydraulic pump drive motor connected to a motor connection of the production housing and which has a rotary output connected through the production inlet of the production housing to the rotor of the rotary pump; the tubing connector comprising:

an integral body arranged for connection in series between the production housing and the production tubing;

a production port in the integral body arranged for communicating between the production tubing and the production passage in the housing;

the production port comprising a threaded connector for threaded connection to the production tubing; and at least one auxiliary port in the integral body which is separate and external from the production port and which is arranged for connection between the hydraulic pump drive motor and a respective pump drive control line extending externally alongside the production tubing.

* * * * *